United States Patent [19]

Newman

[11] 4,004,643

[45] Jan. 25, 1977

[54] MECHANICAL DRILLING JAR

[76] Inventor: James L. Newman, 970 Starewood Drive, Beaumont, Tex. 77706

[22] Filed: Mar. 3, 1976

[21] Appl. No.: 663,438

[52] U.S. Cl. ..... 175/321; 166/65 M; 175/300; 175/308

[51] Int. Cl.[2] ..... E21B 1/10

[58] Field of Search ..... 175/293, 299–304, 175/321, 308; 166/65 M

[56] References Cited

UNITED STATES PATENTS

| | | | |
|---|---|---|---|
| 1,798,337 | 3/1931 | Newsom | 175/304 |
| 1,889,283 | 11/1932 | Francis | 175/300 |
| 2,818,232 | 12/1957 | Osmun | 175/293 |
| 2,819,876 | 1/1958 | Ransom | 175/294 |
| 3,371,730 | 3/1968 | Newman | 175/300 |
| 3,392,795 | 7/1968 | Greer | 175/300 |
| 3,585,301 | 6/1971 | Newman | 175/300 |

*Primary Examiner*—James A. Leppink
*Attorney, Agent, or Firm*—Hubbard, Thurman, Turner & Tucker

[57] ABSTRACT

The specification describes a drilling jar for connection in a rotary drill string. There is a trap space in the jar for collecting the products of wear between its moving parts. The drilling jar includes a generally tubular housing assembly, which has near its bottom, a wash pipe sleeve. There is a tubular mandrel assembly extending into the housing and movable with respect to it, which has near its bottom a wash pipe that slides in the sleeve. An annular trap space is defined near the top of the sleeve between its outer surface and an inner surface of the housing. Wear products are collected in the trap space and thereby prevented from entering between the wash pipe and sleeve where they would cause abrasion.

5 Claims, 4 Drawing Figures

MECHANICAL DRILLING JAR

This invention relates to the art of earth boring, and more particularly, to an improved mechanical jar for connection in a rotary drill string of the type used to drill oil and gas wells.

The present invention is a drilling jar of the type described in my U.S. Pat. No. 3,371,730. Such a jar is a device inserted in a rotary drill string to accomplish the multiple purposes of increasing bit life, producing a straighter hole, and freeing the string in the event that it becomes stuck in the hole.

The two main assemblies of the drilling jar are a generally tubular housing and a tubular mandrel extending into the interior of the housing and movable with respect to it. The housing is ordinarily connected to drill collars below the jar, while the mandrel is connected to the drill string above the jar.

In the use of the jar, the various surfaces of the mandrel bear and slide on those of the housng, generating products of wear, specifically particles of steel. These wear products settle to the bottom of the interior of the housing. In the drilling jar described in the referenced patent, the wear products tend to get between a cylindrical sealing surface in the lower part of the housing and a wash pipe section of the mandrel that slides on the surface. This abrades the surface and destroys an important seal that it provides.

In the drilling jar of the present invention, the housing has an annular trap space concentric with the sealing surface near its top and having an inner diameter greater than the diameter of the sealing surface. Debris can settle in the trap space, removed from the opportunity to enter between the wash pipe and the sealing surface.

In a specific embodiment, there is a chamfer where the wash pipe enters the sealing surface creating a space that could collect some wear particles. The collection of particles in the chamfer space is minimized by its small size compared to the trap space. In addition, a segment of the mandrel with a diameter larger than that of the sealing surface tends to direct debris into the trap space rather than the chamfer space. For these and other reasons, the trap space is an effective feature for reducing the introduction of wear particles between the wash pipe and sealing surface.

The nature of the invention, its features and its advantages, set forth above, may be understood more fully upon consideration of particular embodiments. The following is a description of preferred embodiments and how to make and use them. It is to be read in conjunction with the accompanying drawings wherein.

Figure 1:
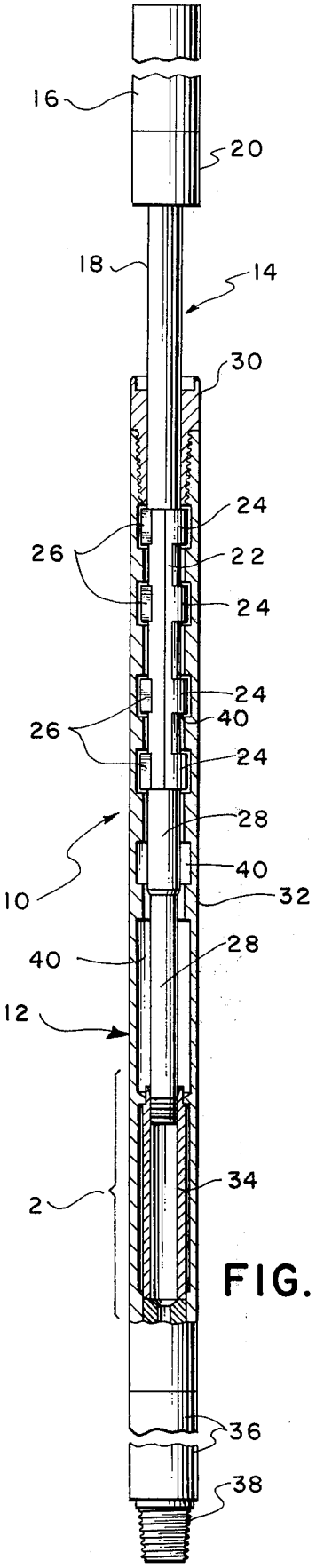
FIG. 1 is a sinplified view, partially in section, of a drilling jar that incorporates the invention, with the mandrel in the extended position.

In FIG. 1, there is seen a drilling jar incorporating the invention, indicated generally by the reference numeral 10. The drilling jar 10 is comprised of a tubular housing assembly and, extending into it, a tubular mandrel assembly, indicated generally by reference numerals 12 and 14 respectively. Housing assembly 12 is constructed of a number of rigidly connected parts, as is mandrel assembly 14, but the two assemblies are movable with respect to each other.

Mandrel assembly 14 has at the top end of a tool joint 16, which is in the form of a drill collar sub a few feet in length with a conventional box tool joint at the end. A tubular mandrel body 18 extends from the tool joint 16 into the housing assembly 12. A cylindrical knocker collar 20 is connected by threads to the mandrel body 18 at the bottom of the tool joint 16. On the mandrel body 18 is fixed a mandrel sleeve 22 on which are formed lugs 24 and 26. Below the mandrel sleeve 22, a tubular wash pipe 28 is connected to mandrel body 18 by threads.

At the top of housing assembly 12 is a cylindrical sealing ring collar 30. This is connected by threads to the large tubular housing body 32. Within the lower portion of housing body 32 is a tubular wash pipe sleeve 34. Housing assembly 12 terminates in a sub 36 connected by threads to the bottom of housing body 32. The sub 36 has a standard tool joint such as the pin 38.

When the drilling jar 10 is used in a drill string, tool joint 16 is preferably connected to the section of drill pipe extending to the surface while pin 38 is connected to the upper end of the drill collars which extend downwardly to the drill bit. As described in the reference patent, the normal operation of the jar 10 transmits torque from the drill pipe above it to the drill collars below, without transmitting an accompanying longitudinal force. If the drill collars become stuck in the bore hole, the drilling jar may be used to apply either an upwardly or downwardly directed impact force in an effort to free them. For example, to apply a downwardly directed impact force, the mandrel assembly 14 and housing assembly 12 are first positioned as shown in FIG. 1. The drill string is then rotated counterclockwise when looking in the down hole direction. In this position, the configurations of lugs 24, lugs 26, and housing body 32 are such that they prevent mandrel assembly 14 from sliding longitudinally with respect to housing assembly 12. The drill string is lowered to apply a force to mandrel assembly 14; then the drill string is rotated in the clockwise direction. The lugs 24 and 26 disengage from housing body 32, allowing mandrel assembly 14 to abruptly slide longitudinally until knocker collar 20 is against sealing ring collar 30. This delivers an impact force to housing assembly 12, and thereby to the string of drill collars below.

During drilling operations, drilling mud is pumped from the drill pipe above drilling jar 10 through a passage down the interior of tubular mandrel assembly 14. The mud then moves through the interior of wash pipe sleeve 34 and a passage through the center of sub 36 to the drill collars below. The passage through which the mud moves does not communicate with and is sealed from a lubricant space 40 between the housing assembly 12 and mandrel assembly 14. The space 40 is preferably filled with a light oil to lubricate the motion of mandrel assembly 14 with respect to housing assembly 12.

Figure 2:
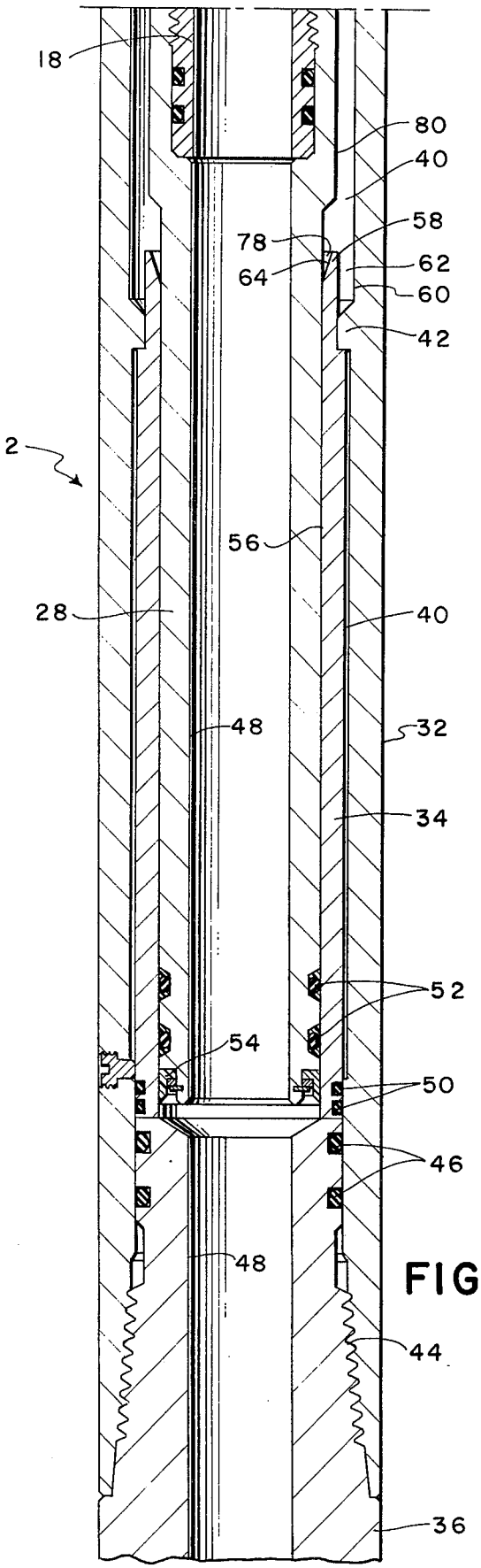
FIG. 2 is an enlarged sectional view of a lower portion of the drilling jar, with the mandrel in the closed position.

FIG. 2 shows a detailed section of drilling jar 10 from the bottom of mandrel body 18 to the top of sub 36. The drilling jar 10 is shown there in the closed position, that is, referring to FIG. 1, with the knocker collar 20 against sealing ring collar 30.

In the closed position, wash pipe 28, which is connected by threads to mandrel body 18, is slid fully into the wash pipe sleeve 34. It can be seen from FIG. 2 that wash pipe sleeve 34 is seated against an annular shoulder 42 of housing body 32. The sleeve 34 is held in place by sub 36 connected to housing body 32 by threads 44. The cylindrical passage 48 is the passage through which drilling mud is pumped down drilling jar 10. O-ring seals 46 prevent the pressure in passage 48 from being applied to threads 44. O-ring seals 50 provide a seal between passage 48 and the annular lubricant space 40 around sleeve 34.

The function of wash pipe 28 is to seal passage 48 from space 40 over the full travel of mandrel assembly 14. Wash pipe 28 is fitted closely to sleeve 34, and the sealng is provided by O-ring seals 52 bearing against sealing surface 56, the cylindrical inner surface of wash pipe sleeve 34. As the parts of the drilling jar 10 move to the closed position, a wiper ring 54 on wash pipe 28 wipes drilling mud off sealing surface 56.

Wash pipe sleeve 34 has a reduced portion 58 which fits under shoulder 42. The cylindrical outer surface of portion 58 has a diameter smaller than the diameter of the inner surface 60 of the surrounding tubular housing body 32. The gap between the outer surface of portion 58 and the inner surface 60 defines an annular trap space 62. On the inner surface of wash pipe sleeve 34, there is a chamfer 64 which has the purpose of facilitating the installation of wash pipe sleeve 34 around wash pipe 28.

Figure 3:
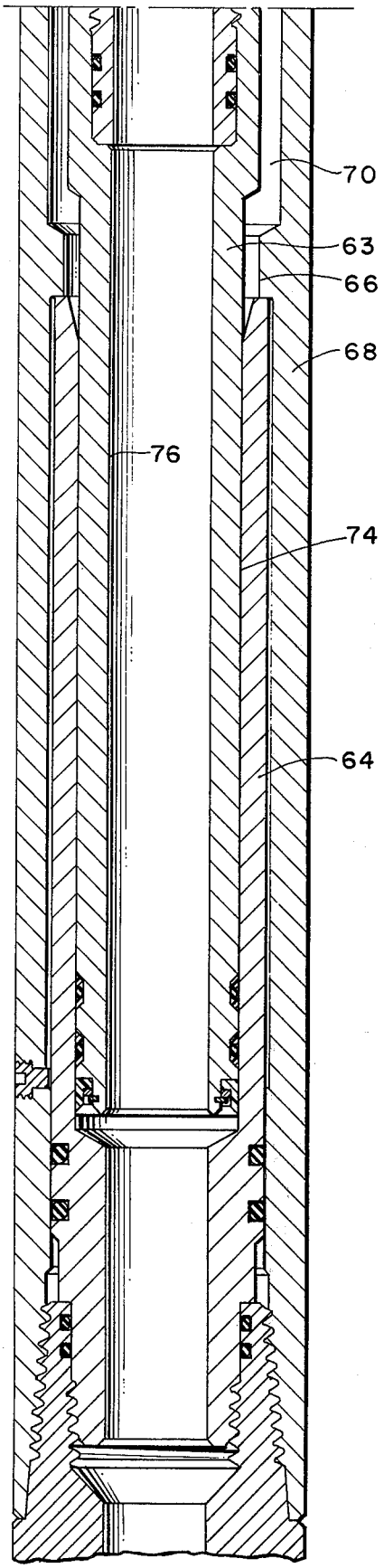
PRIOR ART FIG. 3
FIG. 3 is the same view used in FIG. 2, but of a prior art drilling jar.

FIG. 3 illustrates a prior art drilling jar in which a tubular wash pipe 63 slides in a wash pipe sleeve 64. The sleeve 64 is seated against an annlar shoulder 66 on the inner surface of a tubular housing body 68. An annular space 70 comparable to lubricant space 40 in FIG. 2 is defined between wash pipe 63 and housing body 68. The wash pipe sleeve 64 has no section comparable to the reduced portion 58 of wash pipe sleeve 34 in FIG. 2. As in drilling jar 10 of FIG. 2, the function of the wash pipe 63 is to make with sealing surface 74 of sleeve 64 a seal between space 70 and the cylindrical drilling mud passage 76.

One of the problems that must be dealt with in a drilling jar is the presence of wear products generated by the relative motion of the mandrel assembly and the housing assembly. These are generated, for example, by the engagement, disengagement and impact of lugs 24 and 26 with housing body 32. The products of this wear settle through the lubricating fluid toward the bottom of lubricant space 40. In the prior art drilling jar of FIG. 3, the space 70 comparable to space 40 of FIG. 2, leads only to the junction between wash pipe 63 and wash pipe sleeve 64. Therefore, there is an accumulation of particles which can be drawn between wash pipe 63 and the sealing surface 74 of wash pipe sleeve 64 by the relative motion between wash pipe 63 and sleeve 64. After a time, the presence of particles between these surfaces abrades them both and begins to destroy the seal between space 70 and passage 76.

As can be seen in FIG. 2, trap space 62 provides a place for wear products to settle away from the junction of wash pipe 28 and sleeve 34. Several factors influence the extent to which the wear products collect in trap space 62 rather than the region 78 under chamfer 64. For one thing, it is desirable to make the opening from space 40 into the region 78 small compared with the opening into trap space 62. Another aspect of the configuraton is that trap space 62 directly underlies the nearest portion of space 40, while the region 78 is inset and obstructed to some extent by the larger diameter portion 80 of mandrel assembly 14. Furthermore, as wash pipe 28 slides with respect to sleeve 34, particles in the region 78 are subjected to considerably more disturbance than those in trap space 62. As a result of this disturbance, it can be expected that there will be some net resulting of particles from the region 78

Figure 4:
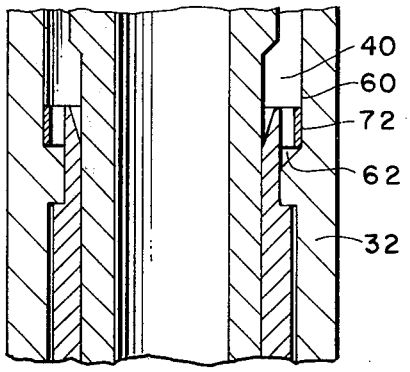
FIG. 4 is a portion of the view taken in FIG. 2, showing an alternate embodiment of the invention.

FIG. 4 illustrates an alternate embodiment of the invention. A thin strip of flexible magnet 72 assumes an annular shape when it is mounted in trap space 62 against the inner surface 60 of housing body 32. Since drilling jar 10 is preferably made of steel, the wear particles in space 40 are of steel and attracted to magent 72, thereby enhancing the degree to which such particles enter trap space 62 and are held there.

Although preferred embodiments of the invention have been described in detail, it is to be understood that changes, substitutions, and alterations can be made therein without departing from the spirit and scope of the invention as defined by the appended claims.

What is claimed is:

1. In a device for connection in a drill string, the combination of:

a housing assembly having an interior cylindrical sealing surface, and a movable assembly within the housing assembly, slideably and sealingly engaged with said surface, the housing assembly having an interior surface above the sealing surface, surrounding the movable assembly and separated therefrom to define a lubricant space opening to the sealing surface, and the housing assembly further having an annular trap space open to the lubricant space and concentric with the sealing surface near its tip, with an inner diameter greater than the diameter of the sealing surface, whereby debris from the lubricant space can settle in the trap space rather than enter between the movable assembly and sealing surface.

2. The combination of claim 1, further including a magnet in said trap space.

3. In a drilling jar, the combination of:

a tubular housing body, a tubular wash pipe sleeve in the housing body, defining in the interior of the tubular sleeve a cylindrical sealing surface, and a tubular mandrel assembly in the body, including a wash pipe sealingly and slideably engaged with the sealing surface, the inner surface of the tubular housing body above the sleeve being separated from the outer surface of the tubular mandrel assembly, defining an annular lubricant space open to the tops of the sleeve and of the sealing surface, and the outer surface of the sleeve near its top being separated from the surrounding inner surface of the tubular housing body, defining an annular trap space open to the lubricant space, whereby debris from the lubricant space can settle in the trap space rather than enter between the wash pipe and sealing surface.

4. The combination of claim 3, further including an annular magnet in said trap space.

5. The combination of claim 3, wherein:

the interior of the tubular sleeve is chamfered at the top of the sealing surface, said outer surface of the sleeve near its tip is a cylinder of a first diameter, the inner surface of the tubular housing body directly above the sleeve forms a cylindrical chamber with a diameter greater than said first diameter, and the mandrel assembly has a cylindrical segment of a diameter greater than the diameter of the sealing surface, said segment being in said chamber when the wash pipe is in its fullest possible engagement with said sleeve.

* * * * *

UNITED STATES PATENT AND TRADEMARK OFFICE

CERTIFICATE OF CORRECTION

PATENT NO. : 4,004,643

DATED : January 25, 1977

INVENTOR(S) : James L. Newman

It is certified that error appears in the above-identified patent and that said Letters Patent are hereby corrected as shown below:

Column 2, line 29, "reference" should be —referenced—.

Column 3, line 33, "annlar" should be —annular—.

Column 4, line 8 , "resulting" should be —resettling—.

Column 4, line 9, after "78" add —into trap space 62.—

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*